United States Patent [19]

Leonard

[11] 4,206,575

[45] Jun. 10, 1980

[54] ENERGY SAVING COVER FOR MOBILE HOME

[76] Inventor: Marvin L. Leonard, Rte. 2, Hillsboro, Mo. 63050

[21] Appl. No.: 942,999

[22] Filed: Sep. 18, 1978

[51] Int. Cl.[2] ..... E04B 1/34

[52] U.S. Cl. ..... 52/3; 52/DIG. 14

[58] Field of Search ..... 52/3, DIG. 14, DIG. 12; 150/52 R, 52 K; 135/14 V; 296/136

[56] References Cited

U.S. PATENT DOCUMENTS

| | | | |
|---|---|---|---|
| 900,350 | 10/1908 | Brooks . | |
| 1,531,622 | 3/1925 | Parsons | 135/14 V |
| 2,048,461 | 7/1936 | Mosgoffian | 296/136 |
| 2,201,984 | 5/1940 | Clark | 135/1 |
| 2,243,981 | 6/1941 | Rowan | 296/136 |
| 2,536,152 | 1/1951 | Bass . | |
| 2,608,198 | 8/1952 | Goodman | 135/4 |
| 2,646,097 | 7/1953 | Gaverth et al. | 150/52 |
| 2,801,667 | 8/1957 | Curran | 150/52 |
| 2,857,949 | 10/1958 | Ziff | 150/52 |
| 3,143,154 | 8/1964 | Best | 150/52 R |
| 3,146,132 | 8/1964 | Nathan | 150/52 X |
| 3,906,129 | 9/1975 | Damois | 150/52 X |

*Primary Examiner*—Price C. Faw, Jr.
*Assistant Examiner*—Carl D. Friedman
*Attorney, Agent, or Firm*—Rogers, Eilers & Howell

[57] ABSTRACT

An insulating and weatherproof protective cover adapted to protect and insulate a mobile home has an outer layer of waterproof material and an inner layer preferably of foam-type insulating material bonded to the outer layer for enclosing the roof and side walls of a mobile home. Openings are cut in the sides to permit the opening and closing of windows and doors. Transparent coverings may be provided which roll up and away from the window openings. Door panels may be provided and hinged from the sides of the mobile home cover to insulate the door. Tie-downs are provided along the lower edge of the cover and may be used to secure the cover to the undercarriage of the mobile home or its supporting pad.

10 Claims, 2 Drawing Figures

FIG. 1.
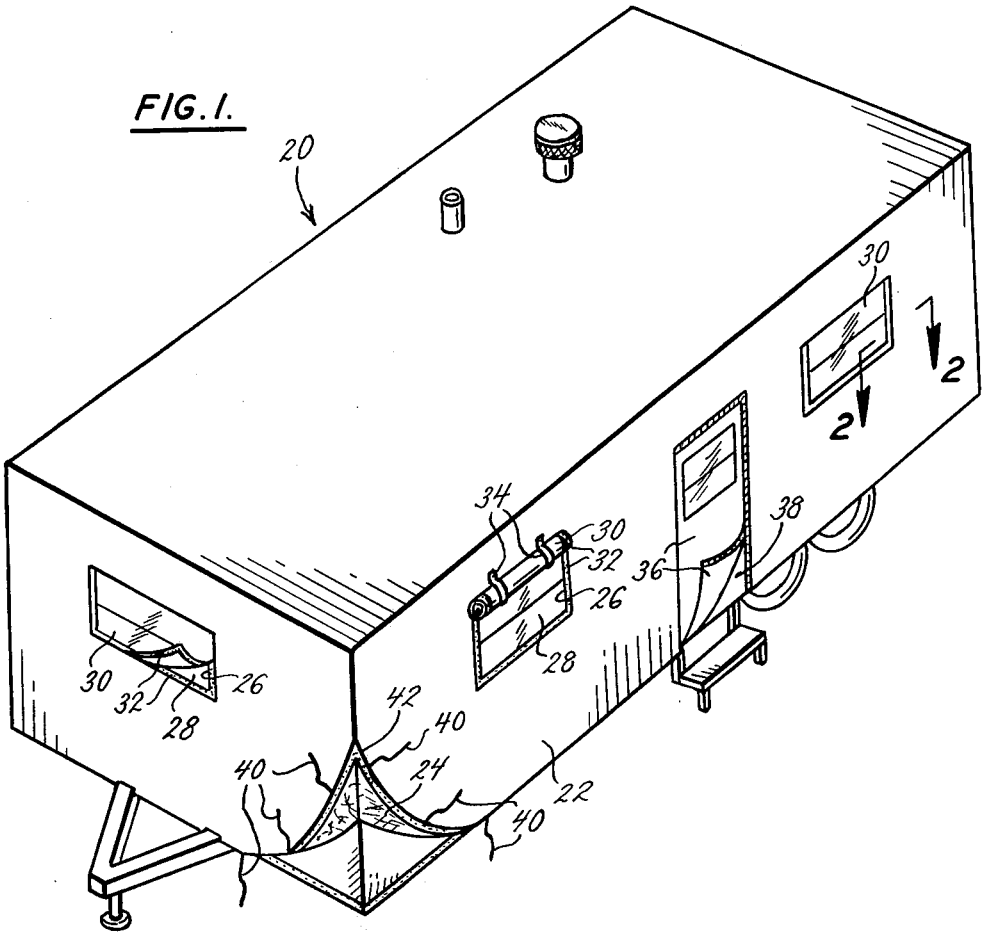
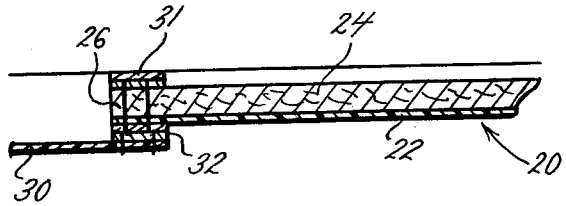
FIG. 2.

ENERGY SAVING COVER FOR MOBILE HOME

BACKGROUND AND SUMMARY

The mobile home industry has made great strides in recent years in improving the ability of the structure to withstand extremes of temperature and, at the same time, be able to maintain a comfortable living environment within. Some of these improvements include thicker walls and increasing the amounts of insulation contained within the walls and ceilings. Nevertheless, these improvements in design have not been enough to keep up with the ever increasing requirements for insulation caused by the energy crisis and the rapidly accelerating price for fuel needed to heat and cool a mobile home. Also, there are a great number of mobile homes that have been previously constructed and sold and which are now being inhabited, but which do not include the improved insulating characteristics required of newly constructed mobile homes.

To improve the energy consumption for both new and older mobile homes as well, applicant has succeeded in developing a combined weatherproof and insulating cover suitable for enclosing the top and side walls of a mobile home. This protective cover has an outer layer to resist the usual extremes of weather including rain, snow, the hot summer sun, hail, and the like. An inner layer of foam insulating material or any other type of insulation impervious to moisture and humidity may be bonded to this protective outer cover and provide the extra insulation required to reduce a mobile home owner's energy bills. As can be appreciated, applicant's mobile home cover may be supplied at a price which will allow an owner to pay for the cover many times over through the savings achieved in his utility bills.

The protective cover may be attractively designed to blend with the decor of the surrounding countryside or otherwise to suit the owner's tastes. Openings may be cut in the protective cover to allow for the easy opening and closing of windows and snaps or other types of closures may be used to attach the protective cover around the border of the window opening. Similarly, openings may be provided for doors to allow free use thereof. Roll-away type plastic or transparent window covers may be provided and fasteners to retain the transparent window coverings in either the up or down position. Door panels may be provided with similar fasteners to attach a panel directly to the door of the mobile home, as desired. A window panel may even be provided in the door panel to accommodate a window in the door.

During installation, it is anticipated that custom holes will be required in the top of the cover to accommodate the various stacks extending through the roof of the mobile home. Thus, applicant's cover may be custom fit to the particular mobile home although basic overall sizes of covers may be provided which would fit a complete manufacturer's line of mobile homes.

The cover extends over the top and along the side walls of the mobile home and may have a series of tie-downs spaced along the bottom of the sides for tying the cover into position and securing it to the mobile home. These tie-downs may be fastened either to the undercarriage of the mobile home or to the mobile home through suitably disposed and anchored hooks, as desired.

Applicant's cover may be made available in kit form to retrofit an existing mobile home. In addition, applicant's cover may be provided as an option by mobile home manufacturers which allows the cover to be custom fit and installed at the manufacturing facility. It has become popular in recent years for mobile home manufacturers to offer energy efficient packages for the purchaser of a new mobile home, but it has been practically impossible to later check to see if the increased amounts of insulation are within the walls of the mobile home. With applicant's cover, the purchaser is assured of receiving the specified amount of insulation and he is easily able to investigate and determine the amount of insulation provided to him in the cover. Thus, it will be much more desirable for a purchaser to select applicant's cover as an optional energy efficient package as he can assure himself of receiving value for his money.

In some locales, it may be desirable to provide applicant's cover with no insulating materials and instead utilize the cover as a windbreak or weatherproofing device. This may be particularly useful in the warmer, wetter climates where air conditioning is unavailable and it is required to ventilate the mobile home to achieve a comfortable living environment. Roll-away transparent window covers are particularly adapted for use in these types of climates.

Applicant's invention may be more fully understood by referring to the drawings and detailed description of the preferred embodiment.

BRIEF DESCRIPTION OF THE DRAWINGS

FIG. 1 is a perspective view of applicant's protective cover installed on a mobile home;

FIG. 2 is an enlarged cross-sectional view taken along the plane of line 2—2 in FIG. 1 which details the closure of the transparent window.

DETAILED DESCRIPTION OF THE PREFERRED EMBODIMENT

Applicant's invention of a protective weatherproof and insulating cover 20 for a mobile home includes an outer layer 22 which is weather resistant and may be constructed of canvas, vinyl, and other similar plastics and synthetic materials which are impervious to rain, snow, hail and the like. An inner layer 24 of insulating material is bonded to the outer layer 22 and substantially increases the effective insulating capabilities of the walls and ceiling of a mobile home. Inner layer 24 may be constructed of a typical foam type polyurethane insulation or any other suitable insulating materials which will adhere to outer layer 22 and which will be impervious to the accumulation of moisture or humidity within the protective cover 20. Window openings 26 may be provided to line up with the windows 28 of a mobile home. If desired, transparent window covers 30 may be provided with fasteners 32 to secure the window covers 30 around the edges of the window openings 26. These fasteners may be snap-type connectors, VELCRO TM type connectors, or zippers, or other suitable types of connectors to secure the transparent window covers 30 in position. A second fastener 31 may be provided along the periphery of window opening 28 and used to secure the cover 20 to the mobile home and prevent the cover 20 from blowing in the wind. The window covers 30 may be flexible and suitable for rolling up and away from the window 28 during those few months out of the year when either heating or cooling is not required. Straps 34 may be provided to secure the window covers 30. Thus, window covers 30 are fully retractable and when in the retracted position will not interfere with free and easy operation of windows 28.

Similarly, a door panel 36 is provided to allow for normal usage of the mobile home door 38 with applicant's protective cover 20 in place. Door panel 36 may be secured to door 38 by any suitable means including snaptype fasteners, a VELCRO TM strip, a zippered connection, or any other suitable connecting structure. If desired, door panel 36 may be eliminated and a door opening provided which would match and line up with the mobile home door 38. This would allow for a consumer's use of his own storm door or other similar weatherproofing structure, if desired. The door panel 36 may be hinged with extra reinforcing structure (not shown) to the side of the protective cover to facilitate the opening and closing of the mobile home door 38 with the door panel 36 installed. Also, a portion of the insulating inner layer 24 may be cut away or other modifications made to accommodate the free swinging of door panel 36.

Applicant's protective cover 20 will generally enclose the roof and four sidewalls of the mobile home and can be secured either to the mobile home or its mounting pad through one of several ways. Tie-downs 40 are spaced along the lower edge 42 of the protective cover 20 where they are secured with suitable reinforcing, as is known in the art. The tie-downs 40 may be used to secure the lower edge 42 of the protective cover 20 to the undercarriage of the mobile home and thus achieve a relatively tight fitting, glove-like covering of the entire mobile home structure. Alternately, eyelets or the like (not shown) may be installed in the pad supporting the mobile home and these may be used to secure the lower edge 42 through use of tie-downs 40. The eyelets may be required for those instances where the undercarriage of the mobile home is not exposed or does not otherwise provide a convenient structure to secure the tie-downs 40. Also, eyelets for tie-downs may already be in existence in those locales where state law requires that mobile homes be secured to a pad, such as by stainless steel cable or the like.

Applicant's protective cover 20 may be provided both in kit form and as an optional feature available with a new mobile home. Many of the older mobile homes were manufactured and sold before the energy crisis experienced within the last several years and thus had reduced amounts of insulation which make them highly uneconomical to both heat and cool. Applicant's protective cover 20 may be purchased by an owner of one of these older mobile homes and it is anticipated that the protective cover 20 would pay for itself many times over by substantially reducing the costs for energy. It is expected that these savings will accelerate in the years to come, thus increasing the benefits to the owner of an older mobile home. In some cases, applicant's protective cover 20 may means the difference between abandoning an older mobile home and its continued utility as a housing unit. By delaying a purchase of new housing for several years, applicant's protective cover 20 will be substantially valuable with an immediate return on the purchaser's investment.

Similarly, although many mobile home manufacturers have greeted the energy crisis by offering optional energy saving packages, this has met with some resistance by prospective purchasers as there is an inherent inability to conveniently check exactly how much insulation has been provided within the walls of a mobile home. It is anticipated that applicant's protective cover 20 may be offered as an optional energy saving package with a much greater salability than those presently available as a prospective purchaser may readily determine exactly how much increased insulation has been provided in return for the dollars spent on the optional feature.

Various changes and modifications may be obvious to one of ordinary skill in the art and they are included within the teachings of applicant's invention. Applicant intends that his invention be limited only by the scope of the claims appended hereto.

What is claimed is:

1. A weatherproof protective cover adapted to protect a mobile home comprising an outer layer of weatherproof material, sand layer sized to fit snugly around and enclose the roof and sidewalls of a mobile home, means defining openings through said cover to permit the unrestricted opening and closing of windows and doors therethrough, means for fastening said cover to the mobile home about the periphery of said openings, and means to secure said cover to the mobile home to prevent relative movement therebetween.

2. The device of claim 1 wherein the protective cover further comprises means to insulate a mobile home, said insulating means including an inner layer of insulating material disposed between the outer layer and the mobile home, said layers being bonded together to inhibit slippage between same.

3. The device of claim 2 further comprising retractable transparent covers for selectively enclosing the window openings in said cover.

4. The device of claim 3 further comprising straps for securing said transparent covers up and away from the window openings in said cover and fasteners for maintaining said transparent covers fully extended over and enclosing the window openings.

5. The device of claim 2 further comprising door panels adapted to be secured to the doors of said mobile home, said door panels allowing the unrestricted opening and closing of said doors.

6. The device of claim 2 wherein said inner layer of insulating material is comprised of a foam type polyurethane insulating material.

7. The device of claim 2 wherein said securing means includes tie-down lines spaced along a lower edge of said cover.

8. The device of claim 7 wherein said tie-down lines are adapted to secure the cover to the undercarriage of the mobile home.

9. The device of claim 7 wherein said tie-down lines are adapted to secure the cover to the mobile home pad.

10. An energy saving, insulating, and weatherproof protective cover adapted to protect and insulate a mobile home and reduce the energy costs to heat and cool same comprising an outer layer of weatherproof material, an inner layer of foam type polyurethane insulating material, said layers being bonded together to eliminate slippage between same, said cover being adapted to snugly enclose and surround the roof and sidewalls of said mobile home, means to custom fit said cover to a mobile home by cutting holes in same to surround stacks in the roof of said mobile home, means defining openings through said cover corresponding to the position of windows and doors in said mobile home, means for fastening said cover to the mobile home about the periphery of said openings, retractable transparent covers attached near the upper edge of said openings for windows for selectively enclosing said openings, straps for securing said transparent covers up and away from the window openings and fasteners for maintaining said transparent covers fully extended over and enclosing the window openings, and tie-downs spaced along the lower edge of said cover and adapted to secure the cover to the mobile home and prevent relative movement therebetween.

* * * * *